United States Patent [19]

Uchida et al.

[11] Patent Number: 4,966,533

[45] Date of Patent: Oct. 30, 1990

[54] VACUUM PUMP WITH ROTATIONAL SLIDING PISTON SUPPORT

[75] Inventors: Akito Uchida; Iwao Sakaguchi, both of Nagano, Japan

[73] Assignee: Kabushiki Kaisha Nagano Keiki Seisakusho, Tokyo, Japan

[21] Appl. No.: 218,775

[22] Filed: Jul. 14, 1988

[30] Foreign Application Priority Data

| | | | |
|---|---|---|---|
| Jul. 14, 1987 | [JP] | Japan | 62-173948 |
| Jul. 14, 1987 | [JP] | Japan | 62-173949 |
| Jun. 29, 1988 | [JP] | Japan | 63-159189 |

[51] Int. Cl.[5] ..... F04B 43/04; F04B 17/04

[52] U.S. Cl. ..... 417/413; 417/417

[58] Field of Search ..... 417/417, 413; 92/98 D; 340/661

[56] References Cited

U.S. PATENT DOCUMENTS

| | | | |
|---|---|---|---|
| 3,542,495 | 11/1970 | Barthalon | 417/416 |
| 4,335,378 | 6/1982 | Coleman | 340/629 |
| 4,599,052 | 7/1986 | Langen et al. | 417/413 |
| 4,773,305 | 9/1988 | Nissels | 92/98 D |

FOREIGN PATENT DOCUMENTS

| | | | |
|---|---|---|---|
| 0211474 | 2/1987 | European Pat. Off. | 417/417 |
| 718971 | 3/1942 | Fed. Rep. of Germany | 417/413 |
| 6143281 | 3/1986 | Japan | 417/417 |

*Primary Examiner*—Leonard E. Smith
*Assistant Examiner*—David W. Scheuermann
*Attorney, Agent, or Firm*—Sughrue, Mion, Zinn, Macpeak & Seas

[57] ABSTRACT

A vacuum pump provided with a restoration coil spring 18 having a reduced size and reduced biasing force to render an overall size of the pump compact includes a casing which defines therein a pumping chamber 6 and an operational chamber 3; a piston 7 reciprocally disposed in the pumping chamber, the piston dividing the pumping chamber into front and rear compartments R1, R2; an operational mechanism disposed in the operational chamber for moving the piston; and, a piston rod 4 having one end connected to the piston, the piston rod extending through the rear compartment and the operational chamber. The operational mechanism includes a solenoid armature 13 on the piston rod, and an electromagnet 14, 15 in the operational chamber.

15 Claims, 6 Drawing Sheets i t1-1
t1-2
i t2-1
t1-1
t2-2
t1-2
i

VACUUM PUMP WITH ROTATIONAL SLIDING PISTON SUPPORT

BACKGROUND OF THE INVENTION

The present invention relates to a vacuum pump which is extremely small in size and light in weight.

A conventional small-sized vacuum pump is constructed as shown in FIG. 10. A casing 120 of the vacuum pump is divided into a pumping chamber 121, an operational chamber 122 and piston rod bearing chamber 123. In one side wall of the pumping chamber 121, an intake valve 124 and a discharge valve 125 are provided so as to cooperate with reciprocal movements of a piston 126. The piston 126 is fixedly secured to one end of a piston rod 127.

An armature unit 128 is fixedly attached to the piston rod 127 located within the operational chamber 122. The armature unit 128 cooperates with an electromagnet M provided within the casing 120. The electromagnet M is comprised of a core C and a coil 129. When the electromagnet M is energized, the armature unit 128 is attracted by the core C. In accordance with the rightward movement of the piston 126, air confined in the pumping chamber 121 is discharged via the discharge valve 125 outside the chamber 121. When, on the other hand, the electromagnet M is deenergized, the rod 127 is moved leftwardly due to restoring force of a spring 130 which is provided over the rod 127 and is interposed between the armature unit 128 and a right hand side wall of the operational chamber 122. When the piston 126 moves leftwardly, air in a chamber (not shown) to be evacuated is sucked via the intake valve 124.

In order to energize the electromagnet M, a pulsating current or a half-wave rectified a.c. current is flowed in the coil 129. To this effect, an a.c. power source or d.c. power source has been used. For the a.c. power source, a commercial a.c. power source of either 50 Hz or 60 Hz is used. When using the d.c. power source, the pulsating current is produced while undergoing switching actions with respect to a d.c. current flowed from the battery.

FIG. 11, there is shown a block circuit diagram illustrating an electric system using the battery. An oscillation circuit 151 outputs pulse trains of a predetermined frequency. A switching circuit 152 receives such pulses and undergoes switching actions in accordance with the pulses fed from the oscillation circuit 151 with respect to a d.c. ccurrent supplied from a battery 153. Thus, the pulsating current is flowed into the coil 129, whereupon the electromagnet M is intermittently energized.

As described, the piston 126 reciprocally moves back and forth due to the attraction force exerted to the armature unit 128 by the energization of the electromagnet M and the restoring force of the spring 130. In the conventional vacuum pump, since the air in the vacuum chamber has been sucked into the pumping chamber 121 by the restoring force of the spring 130, biasing force of the spring 130 must be large for ensuring sucking. Therefore, such spring is generally large in size. On the other hand, air in the chamber 121 is discharged by th energization of the electromagnet M against the biasing force of the spring 130 and therefore, a large size electromagnet is needed to overcome the spring force. As a result, the overall arrangement of the vacuum pump becomes large in size despite a demand in reducing the size of the vacuum pump.

Further, notwithstanding the fact that a requirement exists such that the gap between the outer peripheral surface of the piston 126 and the inner peripheral surface of the chamber 121 be minimized in order to sealingly perform pumping actions, the gap needs to be formed therebetween to allow piston 126 to be smoothly moved. Since these two conflicting requirements are compromised, the sealing of the gap therebetween is not perfect and thus pumping actions cannot be efficiently implemented.

The tip and rear portions of the piston rod 127 are slidingly movably supported by a bearing portion 131 and by the piston rod bearing chamber 123. The piston rod 127 thus supported does not generally rotate about its axis, so that the contacting portions of the piston rod 127 and the bearing portions 131 and 123 are locally abraded. As such, the service life of the piston rod 127 is shortened due to the local frictional wearing.

The circuit shown in FIG. 11 also involves the following disadvantages. The disadvantages are caused by the fact that the waveform of the pulsating current flown in the coil 129, i.e. frequency and duty ratio, is determined depending upon the fixed output from the oscillation circuit 151. The battery voltage is initially high but is gradually lowered as it is used, and the amount of work executed by the armature unit 128 is proportional to an integration value of the current flowed into the coil 129. Accordingly, provided that the duration of the armature unit energization is constant, the amount of work is reduced if the current level is lowered. Reversely, the amount of work is increased if the current level is raised. In this manner, the level of the current changes depending upon the change n the battery voltage, and depending upon the change in the current level; and the amount of work executed by the armature unit 128 changes greatly. Therefore, the suction pressure and discharge pressure of the pump is lowered as time passes, efficiency of the pump cannot be maintained and the operation of the pump becomes unstable. If the vacuum pump is set to perform predetermined operations with a criteria of a relatively lower voltage of the battery, the stroke of the piston is caused to be excessively long in the range of a higher voltage of the battery.

In addition, while it is necessary that when the armature unit moves backward due to the restoring force of the spring 130, the restoring force and the suction or discharging pressure must be balanced. If the discharge pressure is lowered due to the change in load, the return stroke of the armature unit becomes excessively short, whereas when the discharge pressure is increased, the return stroke thereof is excessively long due to a backup pressure of the discharge valve. In this manner, if the stroke of the armature unit 128 is excessively long, the end face of the armature unit 128 impinges upon the side wall of the operational chamber 122, whereby noisy sound and heat are generated. Moreover, the service life of the armature unit is shortened and troubles are liable to occur. Power loss is also caused due to extra work. Where the pump is used under a condition where the pump installation is inclined, and/or used in a circumstance where temperature change and vibrations exist, the pumping action is thereby greatly influenced. For such reasons, an allowable using condition or the purpose for using the pump is restricted. Furthermore, the vacuum pump cannot be made small.

SUMMARY OF THE INVENTION

It is therefore, an object of this invention to overcome the above-described conventional drawbacks and disadvantages and to provide an improved vacuum pump.

Another object of this invention is to provide such vacuum pump in which the size of a restoration spring can be minimumly provided for providing a compact pump yet performing excellent pumping performance.

Still another object of this invention is to provide a compact vacuum pump which provides complete sealing between a pumping chamber and a piston, to thereby enhance pumping efficiency.

Still another object of this invention is to provide a reciprocally moving mechanism which avoids local wearing of a piston rod and a rod bearing portion which slidably supports the piston rod, to thereby prolong a service life of the piston rod.

Still another object of this invention is to provide a vacuum pump controlling apparatus which controls the stroke of an armature so as to be constant regardless of variations in a source voltage.

These and other objects of the present invention will be attained by providing a vacuum pump comprising;

a casing which defines therein a pumping chamber and an operational chamber; the pumping chamber having one side formed with intake and discharge means and having another side positioned in confrontation with the operational chamber;

a piston reciprocally disposed in the pumping chamber, the piston dividing the pumping chamber into front and rear compartments;

an operational mechanism disposed in the operational chamber for moving the piston; and, a piston rod having one end connected to the piston and another end portion, the piston rod extending through the rear compartment and the operational chamber; the operational mechanism comprising;

a solenoid mechanism including an armature portion provided at the piston rod, and an electromagnet provided at the operational chamber for moving the piston in a first direction; and, a restoration spring member for moving the piston in a second direction opposite the first direction the armature portion being positioned between the electromagnet and the rear compartment of the pumping chamber, energization of the solenoid mechanism moving the piston in the first direction against biasing force of the restoration spring for introducing fluid into the front compartment through the intake means, and deenergization of the solenoid mechanism moving the piston in the second direction by the biasing force of the spring for discharing the fluid in the front compartment through the discharge means.

With this structure the size of the restoration spring can be reduced, since only a small force is required for discharging the fluid in the front compartment. In this case, the pressure in the rear compartment of the pumping chamber is higher than that in the front compartment thereof. Therefore, this pressure difference also serves to move the piston in the second direction (toward the front compartment). Minimized size of the restoration spring is also advantageous in that armature portion can be easily moved in the first direction because of the small repellant force of the spring.

In another aspect of this invention, there is provided a vacuum pump comprising;

a casing which defined a pumping chamber and an operational chamber; the pumping chamber having one side formed with intake and discharge means and having another side positioned in confrontation with the operational chamber;

a piston reciprocally disposed in the pumping chamber, the piston dividing the pumping chamber into front and rear compartments, a hollow space being defined between an inner peripheral surface of the pumping chamber and an outer peripheral surface of the piston;

an operational mechanism disposed in the operational chamber for moving the piston;

a piston rod connected to the operational mechanism and having one end connected to the piston, the piston rod extending through the rear compartment and the operational chamber; and, a diaphragm member positioned in the hollow space and disposed between the outer peripheral surface of the piston and the inner peripheral surface of the pumping chamber for sealing the piston with respect to the pumping chamber to thereby sealing the front compartment with respect to the rear compartment, the diaphragm member having a radial slacking length capable of allowing reciprocal motion of the piston.

Because of the provision of the diaphragm member, complete sealing between the pumping chamber and the piston is obtainable.

In still another aspect of this invention, there is provided a vacuum pump comprising;

a casing which defines a pumping chamber and an operational chamber; the pumping chamber functioning as a working chamber for introducing fluid thereinto and discharging the same therefrom and having one side formed with intake and discharge means and having another side positioned in confrontation with the operational chamber;

a piston reciprocally disposed in the working chamber, the piston dividing the working chamber into front and rear compartments;

an operational mechanism disposed in the operational chamber for moving the piston;

a piston rod connected to the operational mechanism and having one end connected to the piston, the piston rod having front and rear portions and extending through the rear compartment and the operational chamber;

a rotational sliding means disposed over the piston rod, the rotational sliding means being rotationally slidable with respect to an inner peripheral surface of the casing; and, a bearing means disposed between the sliding means and the piston rod, the sliding means being rotatable about the piston rod through the bearing means.

The rotational sliding means is rotatable about the piston rod, and is in slide contact with the inner peripheral surface (bearing surface) of the casing during reciprocal movement of the piston. Therefore, no local frictional wearing occurs at the bearing surface and at the piston rod.

In still another aspect of this invention, there is provided a control device in a vacuum chamber adapted to evacuate a meighbouring chamber by reciprocal motion of a piston for controlling the reciprocal movement of the piston, the control device comprising:

a piston rod having one end connected to the piston;

an electromagnet for moving the piston;

a solenoid mechanism including an armature portion provided at the piston rod;

a d.c. power source for supplying a d.c. current;

a switching means for switching the d.c. current to provide a pulsating current having a high level duration and a low level duration duration, the pulsating current being supplied to the electromagnet;

a current detection means for detecting the pulsating current and outputting a current detection signal indicative of the pulsating current thus detected;

an integration means for integrating the current detection signal and outputting an integration signal indicative of an integrated value of the current detection signal;

a comparison means for comparing the integrated value with a reference value and outputting a comparison signal indicative of a difference between the integrated value and the reference value; and a controlling means responsive to the comparison signal for controlling the switching means to change the high level duration of the pulsating current, the controlling means controlling the switching means so that the integrated value coincides with the reference value.

DETAILED DESCRIPTION OF THE PREFERRED EMBODIMENTS

Figure 1:
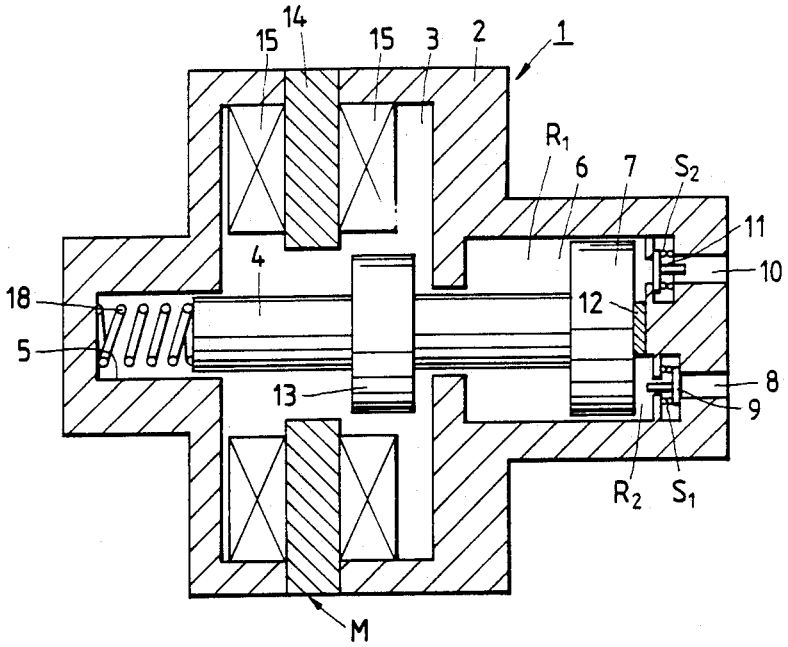
FIG. 1 is a cross-sectional side view showing a vacuum pump according to a first embodiment of the present invention.

A first embodiment according to this invention will be described with reference to FIGS. 1 and 2. The vacuum pump 1 has a casing 2 whose central diametrically enlarged portion is provided with an operational chamber 3. A piston rod bearing chamber 5 is provided at one side of the operational chamber 3 so as to slidably support a rear end portion of a piston rod 4, whereas a pumping chamber 6 is provided at another side of the operational chamber 3.

Within the pumping chamber 6, a piston 7 is reciprocally provided. The piston 7 is fixedly secured to a tip end of the piston rod 4. In other words, the pumping chamber 6 is divided into two chambers R1 and R2 by the piston 7. At a side wall of the pumping chamber 6, intake and discharge passages 8 and 10 are formed. The intake passage 8 is in fluid communication with a chamber to be evacuated (not shown), and the discharge passage 10 is communicated with atmosphere. Intake and discharge valves 9 and 11 are provided at intake and discharge ports of these passages. A coil S1 is provided so as to normally bias the intake valve 9 toward the intake passage 8, whereas another coil spring S2 is provided so as to normally bias the discharge valve 11 toward the pumping chamber 6. In these biasing states, these valves 9 and 11 close the intake and discharge passages 8 and 10. Further, a shock absorbing member 12 is provided in the side wall of the pumping chamber 6 to confront a front end face of the piston 7.

An armature portion 13 is provided on the rod 4, and is positioned in the operational chamber 3. The armature portion 13 is of ring shape and is defined by a diametrically larger portion of the rod 4. Further, an electromagnet M is provided in the operational chamber 3. The electromagnet M includes a core 14 and a driving coil 15 wound thereover. The armature portion 13 is positioned between the core 14 and the pumping chamber 6. Thus, a solenoid mechanism is provided by the combination of the armature portion 13, the core 14 and the coil 15.

The rear end portion of the piston rod 4 is slidable with respect to the piston rod bearing chamber 5 as described above. Further, a restoration coil spring 18 is provided in the bearing chamber 5. The coil spring 18 is interposed between a rear end face of the piston rod 4 and a rear side wall of the chamber 5 so as to normally urge the piston rod 4 toward the pumping chamber 6. In this embodiment, the size of the spring 18 is relatively small having relatively small biasing force.

When the above-described solenoid mechanism is actuated, the piston rod 4 is moved toward the bearing chamber 5 against the biasing force of the coil spring 18, so that fluid (air) in the chamber to be evacuated (not shown) is drawn into the chamber R2 of the pumping chamber through the intake passage 8 and the intake valve 9. In this instance, the fluid in the chamber R1 is gradually compressed. On the other hand, when the solenoid mechanism is deenergized, the piston rod 4 is moved toward the pumping chamber 6 because of the biasing force of the coil spring 18 so as to discharge air in the chamber R2 toward atmosphere through the discharge valve 11 and the discharge passage 10.

Next, detailed operation mode will be described. For the operation of the vacuum pump 1, the electromagnet M is energized so as to attract the armature portion 13, to thereby move it toward the bearing chamber 5. As a result, the piston 7 in the pumping chamber 6 is moved toward the bearing chamber 5 together with the piston rod 4 against the biasing force of the coil spring 18 (in the illustrated embodiment shown in FIG. 1, the piston 7 is moved leftwardly from its rightmost position). As a result, air is introduced into the pumping chamber 6 (chamber R2) from the chamber to be evacuated, since the intake valve 9 is opened against the biasing force of the spring S1 because of the generation of the negative pressure in the chamber R2 whereas the discharge valve 11 is closed by the biasing force of the spring S2 as shown in FIG. 2.

Figure 2:
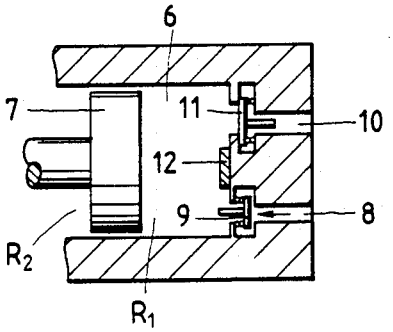
FIG. 2 is a partial cross-sectional side view of the vacuum pump shown in FIG. 1 for description of the operation of the pump.

When the electromagnet M is deenergized the piston rod 4 can be moved toward the pumping chamber 6(as shown in FIG. 1) because of the restorative biasing force of the coil spring 18. In this case, the intake valve 9 is closed by the biasing force of the spring S1 whereas the discharge valve 11 is opened against the biasing force of the spring S2 because of the generation of the positive pressure in the chamber R2. Accordingly, the air in the pumping chamber R2 is discharged toward atmosphere through the discharge valve 11 and the discharge passage 10. In this instance, the movement of the piston 7 is also accelerated by the compressed fluid in the chamber R1, since the pressure in the chamber R2 is lower than that in the chamber R1. Such operations are repeatedly carried out to produce a vacuum pressure in the chamber (not shown) to be evacuated.

In view of the foregoing, according to the first embodiment, the actuation of the solenoid mechanism performs an air intake stroke which requires relatively large energy. In this case, the coil spring 18 has relatively small spring force, so that intake operation can be effectively made because of the small repellant force of the spring 18. Further, deenergization of the solenoid mechanism performs air discharge stroke. In this case the air discharge can be made by the spring 18 and the pressure difference between the chambers R1 and R2. (Pressure in the chamber R2 is higher than that in the chamber R1). Therefore, it is unnecessary to install the corresponding spring having large spring force. In summary, in the first embodiment, even by the small spring 18 having small biasing force, air discharge operation can be effectively performed, to thereby provide a compact vacuum pump which is particularly available for a portable pump.

Figure 3:
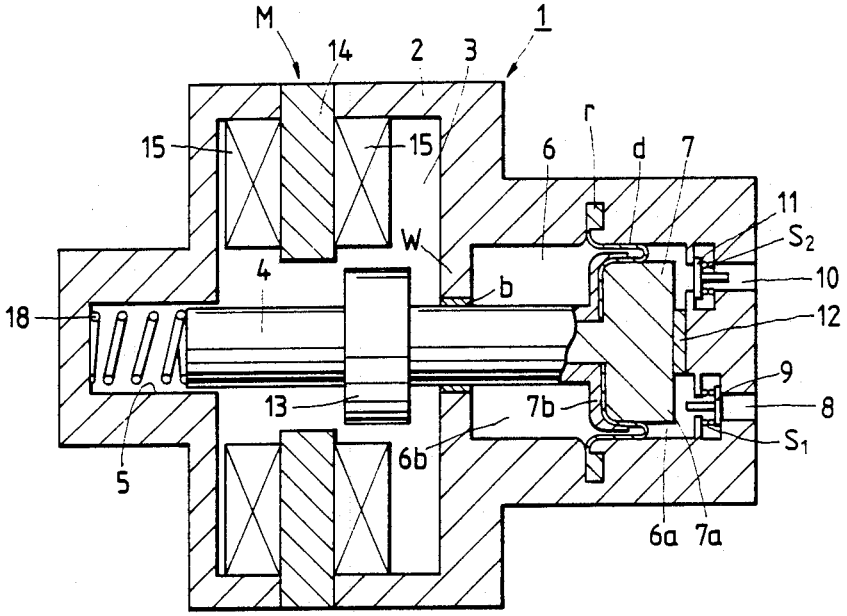
FIG. 3 is a cross-sectional side view showing a vacuum pump according to a second embodiment of the present invention.
Figure 4:
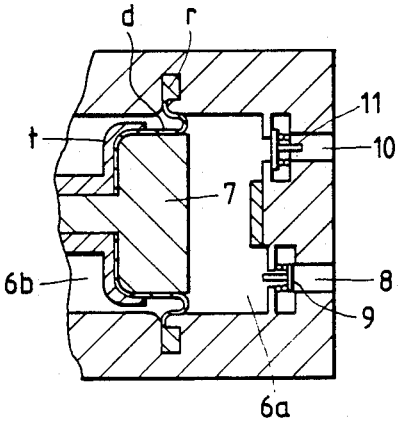
FIG. 4 is a partial cross-sectional side view of the vacuum pump shown in FIG. 3 for description of the operation of the pump.

A second embodiment according to this invention will next be described with reference to FIG. 3 and FIG 4 wherein like parts and components are designated by the same reference numerals and characters as those shown in the first embodiment. In the second embodiment, a piston 7 has a piston main body 7*a* which is held by a cup shaped piston support 7*b* provided at a front end portion of a piston rod 4. Between the piston support 7*b* and the piston main body 7*a*, a radially inner portion of a cup-shaped diaphragm d is interposedly fixed. A radially outer portion r (bead portion) of the diaphragm d is fitted within an annular recess formed in an inner peripheral surface of a pumping chamber 6. The diaphragm d has a radial length sufficient enough to provide a slacking at an annular space t (FIG. 4) which slacking allows the piston 7 to be reciprocally movable. The diaphragm completely seals a front chamber 6*a* relative to a rear chamber 6*b* of the pumping chamber 6 and defined by the piston 7. Further, a partitioning well W is provided between the pumping chamber 6 and the operational chamber 3, and a central bore is formed in the wall W. In the central bore, there is provided a sleeve bearing b so as to support the piston rod 4.

According to the second embodiment, the front chamber 6*a* is completely sealed relative to the rear chamber 6*b* by the diaphragm member d. Therefore, pumping efficiency is greatly enhanced. Further, since the annular space is defined between the outer peripheral surface of the piston 7 and the inner peripheral surface of the pumping chamber 6, no substantial frictional resistance is imparted to the axial movement of the piston 7. As a result, a compact piston driving mechanism is obtainable.

Further similar to the first embodiment, an air intake stroke which requires large energy is achieved by the actuation of a solenoid mechanism including an electromagnet M and an armature portion 13. On the other hand, an air discharge stroke is achieved by a small restoration coil spring 18. In the latter case, since the inner pneumatic pressure in the chamber 6*a* is lower than that in the chamber 6*b*, this pressure difference will give the movement of the piston 7 a little aid in addition to the biasing restoration force of the coil spring 18. As a result, it is unnecessary to provide spring having a large spring force. Furthermore, because of the inner pressure difference between the chambers 6*a* and 6*b*, the diaphragm is urged toward the chamber 6*a* during air discharging stroke. As a result, the pressure difference prevents the diaphragm d from being slackened and rolled into the annular space t even during the discharge stroke.

Figure 5:
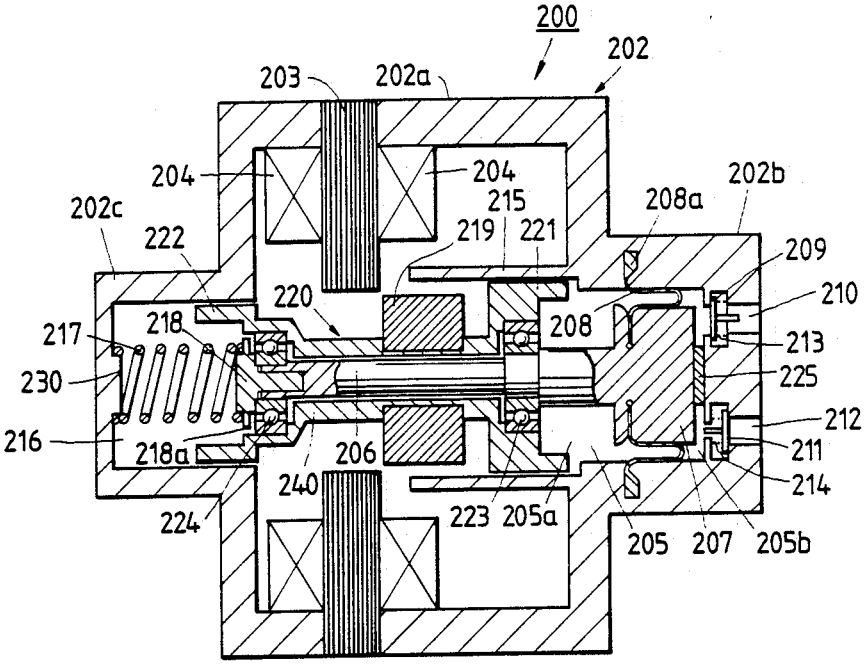
FIG. 5 is a cross-sectional side view showing a vacuum pump according to a third embodiment of the present invention.

A third embodiment according to this invention will be described with reference to FIG. 5. A vacuum pump 200 of this embodiment has a casing 202. The casing 202 has a diametrically larger portion 202*a* at its central portion and diametrically smaller portions 202*b* and 202*c* at each side of the portion 202*a*. Within the diametrically larger portion 202*a*, there a provided a core 203 and coils 204 wound around the core 203. One of the smaller diameter portions 202*b* (front chamber) defines a pumping chamber 205 in which a piston 207 is slidably and reciprocally accommodated. Similar to the second embodiment, a diaphragm member 208 is disposed over the outer peripheral surface of the piston 207 so as to divide the pumping chamber into two chambers 205*a* and 205*b*. A bead portion 208*a* of the diaphragm 208 is fitted within the small diameter portion 202*b*. The small diameter portion 202*b* has a front end wall formed with an intake passage 212 and a discharge passage 210, and intake valve 211 and a discharge valve 209 are provided at ports of the intake and discharge passages, respectively. Further, spring 214 and 213 are in contact with the intake and discharge valves 211 and 209 respectively so as to normally close these valves by their biasing forces. Furthermore, a damper member 225 is provided at the inner side of the front end wall.

A sleeve member 215 extends rearwardly from a rear open end of the smaller diameter portion 202*b*. The sleeve member 215 is provided coaxial with the piston 207 and the front chamber. Further, a rotationally sliding member 220 is in slide contact with the inner peripheral surface of the sleeve member 215. That is, the rotationally sliding member 220 includes a first cylindrical sliding portion 221 having a large diameter at its front portion, a hollow stem portion 240 having a small diameter at an intermediate portion, and a second cylindrical sliding portion 222 at the rear portion of the member 220. An outer peripheral surface of the first sliding portion 221 is in slide and rotational contact with the inner peripheral surface of the sleeve member 215, and an outer peripheral surface of the second sliding portion 222 is in slide and rotational contact with an inner peripheral surface of the rear chamber 202*c* (small diameter portion).

A piston rod 206 coaxially extends through the rotationally sliding member 220. The front end of the piston rod 206 is fixed with the piston 207, a front portion of the rod 206 is rotatably supported by the first sliding portion 221 through a first ball bearing 223, and a rear portion of the rod 206 is rotatably supported by the second sliding portion 222 through a second ball bearing 224. Thus, sliding movement of the piston 207 is guided by the sleeve member 215 and the rear chamber 202c through the rotationally sliding member 220, since the latter rotatably supports the piston rod 206 through the first and second bearings 223 and 224. In this embodiment, an outer diameter of the first sliding portion 221 is slightly larger than that of the second sliding portion 222. Further, the sleeve member 215 and the bearing chamber member 202c are formed of a material having a wear resistivity higher than that of a material of the first and second sliding portions 221, 222.

It should be noted that the rotationally sliding member 220 is rotatable about its axis and with respect to the piston rod 206, but prevents the piston rod 206 from being axially movable relative to the member 220. Therefore, the piston 207 together with the piston rod 206 and the rotationally sliding member 220 are axially moved together.

At the intermediate stem portion 240 of the rotationally sliding member 220, there is provided an armature portion 219 which displaces the piston 207 rearwardly (toward the rear chamber 202c) because of the co-operation with the electromagnet (core 203 and the coil 204).

The rear chamber 202c (another small diameter portion of the casing 202) has a rear end wall, and a coil spring 217 is disposed in the rear chamber 202c. A rear end portion 218 of the piston rod 206 confronts the rear chamber 202c. The rear end portion 218 is provided with a flange portion 218a which supports a front end of the coil spring 217. Therefore, the flange portion 218a serves as a spring seat. The rear end wall of the rear chamber 202c has an inner surface formed with a circular projection 230 with which a rear end of the coil spring 217 is engaged. Thus, the rear small diameter chamber 202c serves as a bearing chamber 216 which rotatably supports the rear end portion of the piston rod 206. Therefore, the piston 207 is normally urged toward the front chamber 205b by the biasing force of the spring 230 as shown in FIG. 5.

In this third embodiment, the first and second sliding portion 221, 222 and the intermediate portion 240 are integrally provided. However, the first sliding portion 221 can be formed separately with respect to the second sliding portion 222.

When an electrical current is applied to the coil 204, the core 203 is magnetized, so that the armature portion 219 is attracted by the core 203. As a result, the piston rod 206 is moved toward the rear small diameter portion 202c against the biasing force of the coil spring 217. In this case, similar to the first and second embodiments, since the coil spring 217 has a small spring force, the magnetic attractive force easily overcomes the biasing force of the spring 217. By the leftward movement of the piston 217, air in a chamber (not shown) to be evacuated is introduced into the front chamber 205b of the pumping chamber 205 through the intake passage 212 and the intake valve 211. The intaken air is then discharged through the discharge valve 209 and the discharge passage 210 upon movement of the piston 207 in the opposite direction. This opposite movement will be stopped upon abutment of the front end face of the piston 207 against the damper member 225.

During the axial movement of the piston rod 206, the first sliding portion 221 of the rotationally sliding member 220 is slidingly rotatable relative to the inner peripheral surface of the sleeve member 215, even through no particular rotational force is subjected to the first sliding portion 221, and at the same time, the second sliding portion 222 of the rotationally sliding member 220 is also slidingly rotatable relative to the inner peripheral surface of the bearing chamber 216 during the axial movement of the piston 207. Accordingly, no local frictional wearing is provided between the sliding portions 221, 222 and the sleeve 215,202c because of the rotation-free structure of these sliding portions 221,222 relative to the piston rod 206. As a result, prolonged service life of these sliding portions is obtainable.

According to the third embodiment, the material of the sleeve member 215 and the bearing member 202c have wear resistance higher than that of the material of the first and second sliding portions 221, 222 as described above. Therefore, during the reciprocal motion of the piston rod 206, both sliding portions 221 and 222 are firstly worn out. In an aspect of a machining, it would be more difficult to machine the inner surface of the casing 202 than to machine to the outer surface of the rotationally sliding member 220. In this connection, this difference in wear resistivity is advantageous in that the rotationally sliding member 220 whose frictional wearing speed is higher than that of the casing 202 is merely replaced by a new one. In other words, it is unnecessary to replace the casing 202 by a new one whose machining is troublesome.

Next, description will be made with respect to a control device for use in the vacuum pump according to the present invention.

Figure 6:
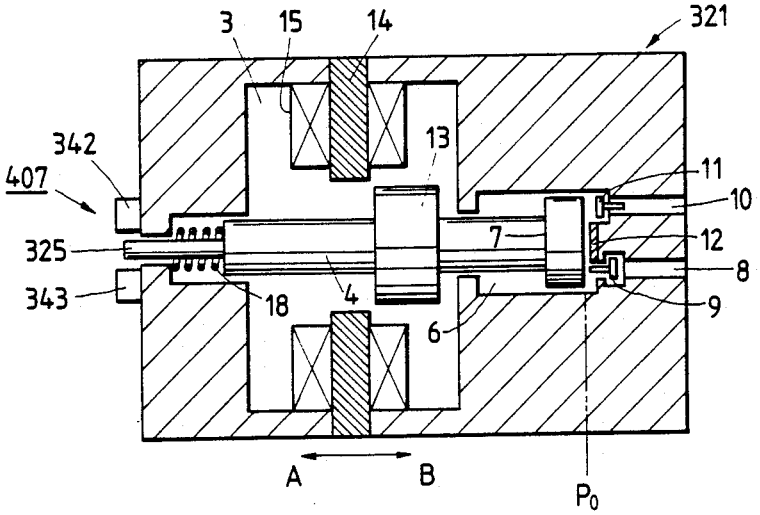
FIG. 6 is a cross-sectional side view showing a vacuum pump provided with a detector for detecting a position of a piston rod.

The vacuum pump to which the control device is applied is constructed as shown FIG. 6, in which a detection rod 325 is attached to the rear end portion of the piston rod 4 so as to protrude through a hole formed on the rear side wall of the pump casing 321. A light emitting unit 342 and a light receiving unit 343 are provided at the exit of the through-hole to thereby detect the position of the piston rod 4 or the position of the piston 7.

Figure 7:
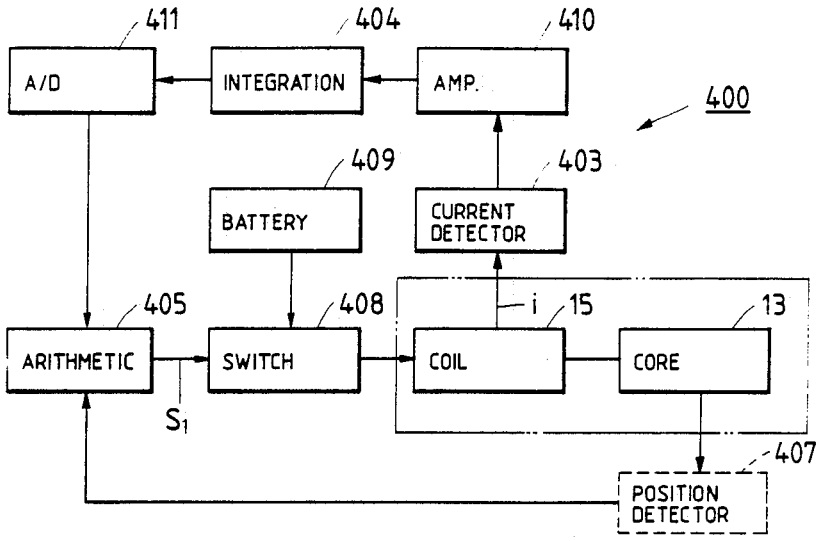
FIG. 7 is a block diagram showing a vacuum pump controlling device according to the present invention.

Referring to FIG. 7, a switching circuit 408 is connected to the coil 15, and to the switching circuit 408 a battery 409 and an arithmetic circuit 405 are connected. The switching circuit 408 is rendered ON when a control signal S1 fed from the arithmetic circuit 405 is at a high level, whereas the switching circuit 408 is rendered OFF when the control signal S1 is at low level. When the switching circuit 408 is ON, the battery 409 is connected to the coil 15, whereas when the switching circuit 408 is OFF, the battery 409 is disconnected from the coil 15. In this manner, a pulsating current is supplied to the coil 15 in accordance with the level of the control signal S1.

To the coil 15, a current detection circuit 403 is connected. The current detection circuit 403 is, for example, made up of a resistor connected in series to the coil 15. A voltage developed across the resistor is derived as a current detection signal. The current detection signal is amplified by an amplifier 410 when necessary, and the resultant signal is supplied to an integration circuit 404 for integration of the current detection signal. The output of the integration circuit 404 is supplied to an analog-to-digital (A/D) converter 411 where the integrated value is subjected to analog-to-digital conversion, and the resultant digital signal is applied to the arithmetic circuit 405.

The arithmetic circuit 405 is constituted with a microprocessor formed with an IC chip and implements arithmetic operations in accordance with a predetermined software program. A memory is provided in the interior of the arithmetic circuit 405, in which a reference value is stored. The reference value is determined so that an optimum pulsating current is supplied to the coil 15. The integration value fed from the A/D converter 411 is compared with the reference value, and the control signal S1 is produced from the arithmetic circuit 405 depending upon a difference between the integration value and the reference value. In response to the control signal S1, the pulse duration or the high level duration of the pulsating current is controlled. Specifcally, when the integration value is larger than the reference value, the control signal S1 is outputted from the arithmetic circuit 405 which causes the pulse duration of the pulsating current to be shortened to a degree that a difference between the integration value and the reference value is zeroed. On the other hand, when the integration value is smaller than the reference value, the control signal is produced which causes the pulse duration of the pulsating current to be extended to a degree that the difference therebetween is zeroed. The correction of the pulse duration may be implemented by repeatedly carrying out the corrections while correcting a fixed value in one implementation. It is to be noted that the arithmetic circuit 405 is provided with an oscillation function, and a control signal having a reference frequency is ordinarily produced. As described, while effecting the waveform shaping of the pulsating current, the amount of work performed by the pump can be maintained at a constant level and the pumping efficiency can be maintained stable even if there is a variation in the power source voltage.

The output from the position detector 407 is supplied to the arithmetic circuit 405 to control the non-pulse duration or the low level duration of the pulsating current so that the armature portion is stopped at a regular position when the latter moves to the rightmost position. Specifically, in the case where the intake stroke of the armature 13 is excessively long, the discharge stroke also tends to be long and thus the armature portion 13 is liable to impinge upon the damper 12. Therefore, the non-pulse duration is shortened and the current is flowed in the coil 15 when the piston 13 has reached the regular position $P_0$ immediately rear of the damper face. When, on the other hand, the intake stroke of the armature 18 is excessively small, the non-pulse duration is extended. As a result, the stroke of the armature 18 can be maintained at a constant distance regardless of the variations in the power source voltage or the load, whereby the noisy sound or heat which may otherwise be generated if the piston 7 impinges the damper 12 can be prevented. Further, occurences of trouble and shortening of the service life can be prevented.

Figure 8:
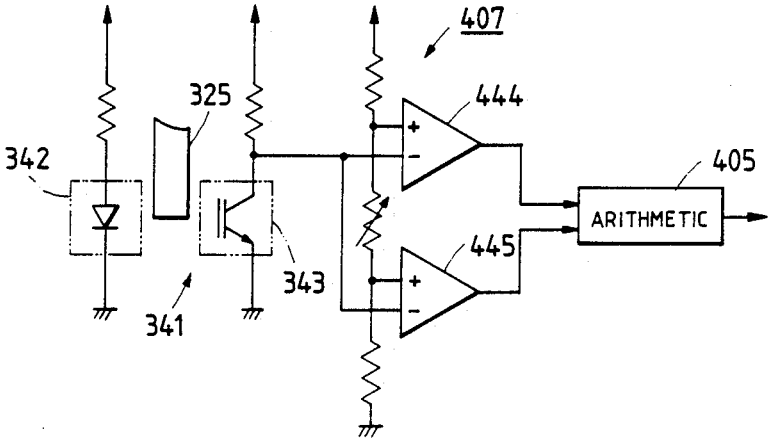
FIG. 8 is a circuit diagram of the detector shown in FIG. 7.

The position detector 407 is configured as shown in FIG. 8. A top end portion of the position detection rod 325 is intervened between the light emitting unit 342 and the light receiving unit 343 both constituting the position detector. Depending upon the position of the rod 325, the output of the light receiving unit 343 is changed. More specifically, when the piston is undergoing a larger level of intake operation, a larger areas of the cross-section of the light beam is interrupted by the rod 325 and the output voltage of the light receiving unit 343 becomes small. On the other hand, when the piston is undergoing a smaller level of intake operation, a smaller area of the cross-section of the light beam is interrupted by the rod 325 and the output voltage of the light receiving unit 343 becomes high. The output of the light receiving unit 343 is applied to inverting input terminals of a pair of comparators 444 and 445, to the non-inverting inputs of which reference voltages differing from each other are applied. When the output voltage of the light receiving unit 343 is between the two differing reference voltages and the outputs from the respective comparators 444 and 445 are "1" and "0" or vice versa, the stroke of the piston is judged so that it falls when an allowable range. When the outputs of the comparators are either "0" to "0" relation or "1" to "1" relation, the stroke of the piston is judged so that it is excessively short or excessively long. The arithmetic unit 405 receives the outputs of the comparators 444 and 445 and outputs the control signal S1 which causes the non-pulse duration of the pulsating current to be changed so that the outputs of the comparators 444 and 445 becomes "1" to "0" (or vice versa) relation.

Figures 9A, 9B, 9C, 9D:
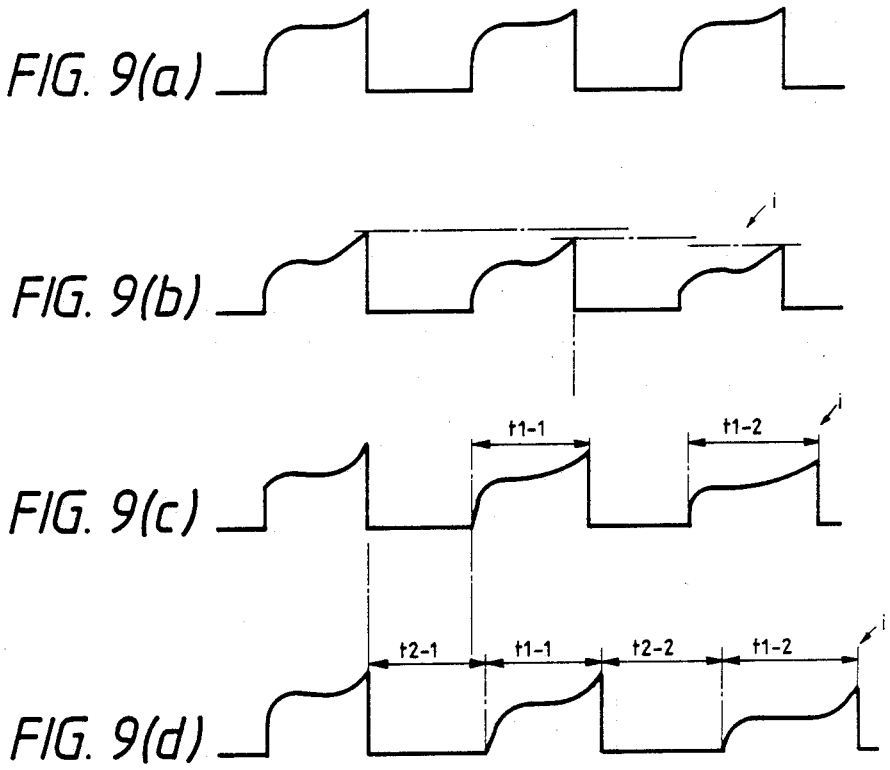
FIG. 9 is a timing chart showing a current flowing in a coil provided in the vacuum pump shown in FIG. 7.
Figure 10:
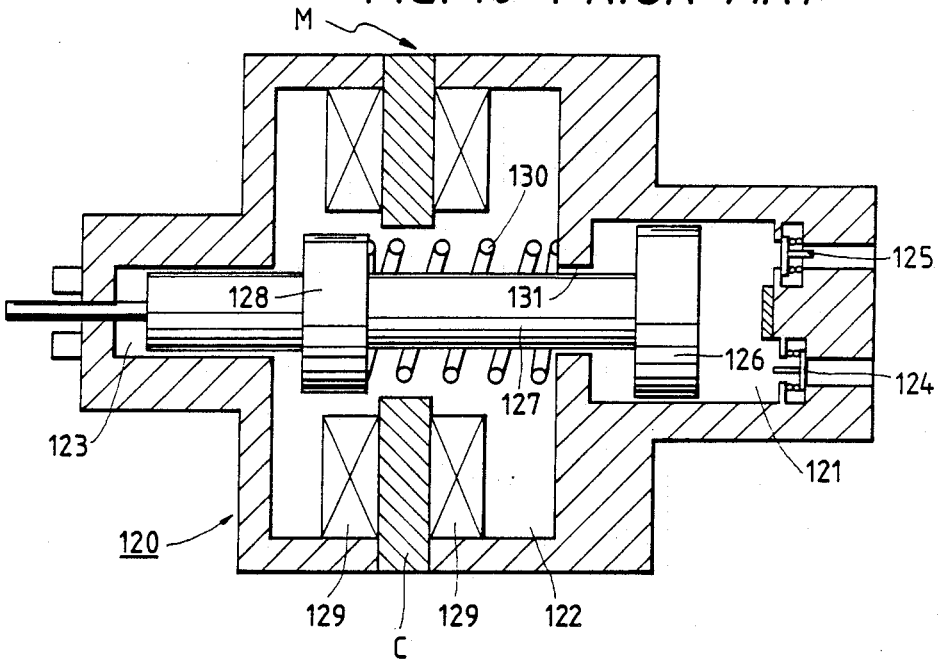
FIG. 10 PRIOR ART
FIG. 10 is a cross-sectional side view showing a conventional vacuum pump.
Figure 11:
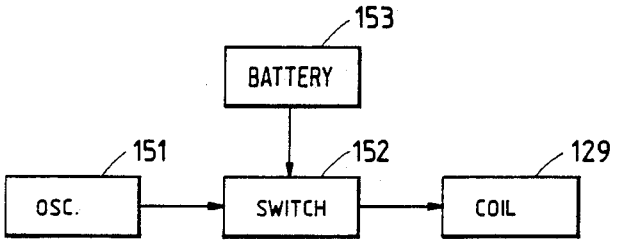
FIG. 11 PRIOR ART
FIG. 11 is a block diagram showing a control device of the conventional vacuum pump shown in FIG. 10.

FIGS. 9(*a*) through 9(*d*) are waveform diagrams showing the waveforms of the pulsating currents flowed into the coil 15. FIG. 9(*a*) indicates an ideal condition of the pulsating current in which the current level in each cycle is maintained unchanged. FIG. 9(*b*) indicates an actual waveform in which the current level in the subsequent cycle is slightly lowered with respect to that in the preceding cycle. FIG. 9(*c*) indicates the waveform of the pulsating current according to the present invention, in which the pulse durations (t1-1), (t1-2) are extended as the level of the current is lowered. FIG 9(*d*) indicates the waveform of the pulsating current in which the waveform in FIG. 9(*c*) is further subjected to position correction so as to extend non-pulse durations (t2-1), (t2-2). That is, the correction attendant to the current detection and the correction attendant to the position detection are alternatively carried out. These corrections are carried out with respect to the waveform appearing after the cycle in which detection is carried out. The current based correction and the position based correction mutually influence each other, and therefore, the two types of corrections are repeatedly carried out until an optimum condition is attained. In other words, the arithmetic circuit 405 implements arithmetic operations to give an appropriate frequency f defined by $f=60/\{(t1\text{-}1)+(t2\text{-}1)\}$ under the consideration of the duty ratio $r=(t1\text{-}1)/(t2\text{-}1)$.

While the control device of the vacuum pump has been described with reference to specific embodiments, it should be understood that the present invention is not limited thereto but a variety of changes of modifications may be made without departing from the scope and spirit of the invention. For example, the current detection circuit, integration circuit and the arithmetic circuit can be replaced by differently arranged circuits provided with the same functions. The pump to which the control device is applied is not limited to those depicted in the drawings, but the control device can also be applied to differently configured pumps. An auxiliary circuit may be added to the control device insofar as the intended function can substantially be attained.

As described, with the control device according to one embodiment of the present invention, the level of the pulsating current flowed into the coil is detected and integrated, and then the integrated value is compared with a reference value, whereupon the pulse duration of the pulsating current is changed so that the difference between the integrated value and the reference value is zeroed. With the control device according to another embodiment of the present invention, the position of the armature is detected and the position detection signal and a reference signal are subjected to comparison and arithmetic operation to produce a control signal which causes the non-pulse duration of the pulsating current to change so that the armature is disposed in a regular position corresponding to the reference value. As such, the present invention provides the following effects.

First, even if the source voltage changes and accordingly the level of the current flowed into the coil changes, the amount of work executed by the armature of the piston is maintained at a constant value. Therefore, the efficiency of the pump per se can be maintained constant regardless of the period of time during which the pump is used. Secondly, even if the source, voltage changes during the operation of the pump or the intake pressure fluctuates due to the fluctuation of the load, the armature always stops at the predetermined regular position. Therefore, overrun of the piston, generation of noisy sound and/or heat, occurence of troubles, and shortening of the service life all of which may otherwise occur if the piston overruns, can be prevented. Thirdly, the pumping efficiency can be maintained constant regardless of the place where the pump is disposed or condition for using the same. Therefore, the pump can be used anywhere and used for extensive purposes. Finally, since the amount of work executed by the pump can always be maintained at a constant level, energy is not wasted and power efficiency is enhanced. Further, the pump can be made compact in size.

What is claimed is:

1. A vacuum pump comprising:

a casing which defines therein a pumping chamber and an operational chamber; said pumping chamber having a side formed with intake and discharge means and having another side positioned in confrontation with said operational chamber;

a piston reciprocally disposed in said pumping changer, said piston dividing said pumping chamber into front and rear compartments;

an operational mechanism disposed in said operational chamber for moving said piston;

a piston rod having one end connected to said piston and another end portion, said piston rod extending through said rear compartment and said operational chamber;

a rotationally sliding member disposed over said piston rod; and bearing means disposed between said rotationally sliding member and said piston rod for rotatably supporting said rotationally sliding member with respect to said piston rod, said rotationally sliding member being in rotational slide contact with said casing, whereby said rotationally sliding member is rotatable during axial movement of said piston rod;

said operational mechanism comprising:

a solenoid mechanism including an armature portion provided on said piston rod, and an electromagnet provided in said operational chamber for moving said piston in a first direction; and, a restoration spring member for moving said piston in a second direction opposite said first direction; said armature portion being positioned between said electromagnet and said rear compartment of said pumping chamber, energization of said solenoid mechanism moving said piston in said first direction against as biasing force of said restoration spring for introducing fluid into said front compartment through said intake means, and deenergization of said solenoid mechanism moving said piston in said second direction by biasing force of said spring for discharging said fluid in said front compartment through said discharge means.

2. The vacuum pump as defined in claim 1, wherein said casing further defines a piston rod bearing chamber at a position opposite said pumping chamber with respect to said operational chamber for supporting said another end portion of said piston rod, said restoration spring being disposed in said piston rod bearing chamber for urging an end face of said another end portion of said piston rod.

3. The vacuum pump as defined in claim 2, further comprising a position detector means provided at said casing and said piston rod to thus detect a position of said solenoid mechanism.

4. The vacuum pump as defined in claim 3, wherein said bearing chamber has a rear end wall formed with a through-hole, and wherein said position detector means comprises a position detection rod extending from said end face of said another end portion of said piston rod, said position detection rod being protrudable through said through-hole, and detection means provided at said casing for detecting a protruding length of said position detection rod.

5. The vacuum pump as defined in claim 1, wherein said pumping chamber has an inner peripheral surface, and said piston has an outer peripheral surface, a hollow space being defined between said inner and outer peripheral surfaces; and further comprising; a diaphragm member provided between said outer peripheral surface of said piston and said inner peripheral surface of said pumping chamber for providing sealing relationship between said front and rear compartments of said pumping chamber; said diaphragm member having a radial length capable of allowing reciprocal motion of said piston.

6. The vacuum pump as defined in claim 1, further comprising;

a sleeve member extending from said rear compartment into said operational chamber;

a piston rod bearing chamber positioned opposite said pumping chamber with respect to said operational chamber, said rotationally sliding member including a first sliding portion at said front portion of said piston rod, and a second sliding portion at said rear portion of said piston rod, said first sliding portion being in rotational slide contact with an inner peripheral surface of said sleeve member, and said second sliding portion being in rotational slide contact with an inner peripheral surface of said piston rod bearing chamber.

7. A vacuum pump comprising;

a casing which defines a pumping chamber and an operational chamber; said pumping chamber having one side formed with intake and discharge means and having another side positioned in confrontation with said operational chamber;

a piston reciprocally disposed in said pumping chamber, said piston dividing said pumping chamber into front and rear compartments, a hollow space being defined between an inner peripheral surface of said pumping chamber and an outer peripheral surface of said piston;

an operational mechanism disposed in said operational chamber for moving said piston;

a piston rod connected to said operational mechanism and having one end connected to said piston, said piston rod extending through said rear compartment and said operational chamber;

a diaphragm member positioned in said hollow space and disposed between said outer peripheral surface of said piston and said inner peripheral surface of said pumping chamber for sealing said piston with respect to said pumping chamber to thereby seal said front compartment with respect to said rear compartment, said diaphragm member having a radial slacking length capable of allowing reciprocal motion of said piston;

a d.c. power source for supplying a d.c. current;

a switching means for switching said d.c. current to provide a pulsating current having a high level duration and a low level duration, said pulsating current being supplied to said electromagnet;

a current detection means for detecting said pulsating current and outputting a current detection signal indicative of said pulsating current thus detected;

an integration means for integrating said current detection signal and outputting an integration signal indicative of an integrated value of said current detection signal;

a comparison means for comparing said integrated value with reference value and outputting a comparison signal indicative of a difference between said integrated value and said reference value; and a controlling means responsive to said comparison signal for controlling said switching means to change said high level duration of said pulsating current, said controlling means controlling said switching means so that said integrated value coincides with said reference value.

8. The vacuum pump as defined in claim 5, wherein said piston comprises, a main piston body, and a cup shaped support member fixed to a front end portion of said piston rod for receiving said main piston body, and wherein said diaphragm member has a cup-shaped configuration and has a radially inner end portion interposed between said main piston body and said cup shaped support member.

9. A vacuum pump comprising;

a casing which defines a pumping chamber and an operational chamber; said pumping chamber functioning as a working chamber for introducing fluid thereinto and discharging the same therefrom and having one side formed with intake and discharge means and having another side positioned in confrontation with said operational chamber;

a piston reciprocally disposed in said working chamber, said piston dividing said working chamber into front and rear compartment;

an operational mechanism disposed in said operational chamber for moving said piston;

a piston rod connected to said operational mechanism and having one end connected to said piston, said piston rod having front and rear portions and extending through said rear compartment and said operational chamber;

a rotational sliding means disposed over said piston rod, said rotational sliding means being rotationally slidable with respect to an inner peripheral surface of said casing; and a bearing means disposed between said sliding means and said piston rod, said sliding means being rotatable about said piston rod through said bearing means.

10. The vacuum pump as defined in claim 9, further comprising;

a sleeve member extending from said rear compartment into said operational chamber;

a piston rod bearing chamber positioned opposite said pumping chamber with respect to said operational chamber, said rotationally sliding means including a first sliding portion at said front portion of said piston rod, and a second sliding portion at said rear portion of said piston rod, said first sliding portion being in rotational slide contact with an inner peripheral surface of said sleeve member and said second sliding portion being in rotational slide contact with an inner peripheral surface of said piston rod bearing chamber.

11. A vacuum pump comprising:

a casing which defines therein a pumping chamber and an operational chamber; said pumping chamber having one side formed with intake and discharge means and having another side position in confrontation with said operational chamber;

a piston reciprocally disposed in said pumping chamber, said piston dividing said pumping chamber into front and rear compartments;

an operational mechanism disposed in said operational chamber for moving said piston;

a piston rod having one end connected to said piston and another end portion, said piston rod extending through said rear compartment and said operational chamber;

a d.c. power source for supplying a d.c. current;

a switching means for switching said d.c. current to provide a pulsating current having a high level duration and a low level duration, said pulsating current being supplied to said electromagnet;

a current detection means for detecting said pulsating current and outputting a current detection signal indicative of said pulsating current thus detected;

an integration means for integrating said current detection signal and outputting an integration signal indicative of an integrated value of said current detection signal;

a first comparison means for comparing said integrated value with a first reference value and outputting a first comparison signal indicative of difference between said integrated value and said first reference value; and a first controlling means responsive to said first comparison signal for controlling said switching means to change said high level duration of said pulsating current, said first controlling means controlling said switching means so that said integrated value coincides with said first reference value;

said operational mechanism comprising:

a solenoid mechanism including an armature portion provided on said piston rod, and an electromagnet provided in said operational chamber for moving said piston in a first direction; and a restoration spring member for moving said piston in a second direction opposite said first direction; said armature portion being positioned between said electromagnet and said rear compartment of said pumping chamber, energization of said solenoid mechanism moving said piston in said first direction against a biasing force of said restoration spring for introducing fluid into said front compartment through said intake means, and deenergization of said solenoid mechanism moving said piston in said second direction by the biasing force of said spring for discharging said fluid in said front compartment through said discharge means.

12. A vacuum pump as defined in claim 11, further comprising a position detector means provided at said casing and said piston rod to thus detect a position of said solenoid mechanism and outputting a position signal indicative of the position of said solenoid mechanism; a second comparison means for comparing said position signal with a second reference value and outputting a second comparison signal indicative of a difference between said position signal and said second reference value; and a second controlling means responsive to said second comparison signal for controlling said switching means to change said low level duration of said pulsating current, said second controlling means controlling said solenoid mechanism so as to be disposed in a predetermined position corresponding to said second reference value.

13. A vacuum pump as defined in claim 9, further comprising:

a d.c. power source for supplying a d.c. current;

a switching means for switching said d.c. current to provide a pulsating current having a high level duration and a low level duration, said pulsating current being supplied to said electromagnet;

a current detection means for detecting said pulsating current and outputting a current detection signal indicative of said pulsating current thus detected;

an integration means for integrating said current detection signal and outputting an integration signal indicative of an integrated value of said current detection signal;

a comparison means for comparing said integrated value with a reference value and outputting a comparison signal indicative of a difference between said integrated value and said reference value; and a controlling means responsive to said comparison signal for controlling said switching means to change said high level duration of said pulsating current, said controlling means controlling said switching means so that said integrated value coincides with said reference value.

14. In a vacuum pump for evacuating a chamber by reciprocally moving a piston, a control device for controlling the reciprocal movement of said piston comprising:

a piston rod having one end connected to said piston;

a solenoid mechanism including an armature portion (13) provided on said piston rod; and an electromagnet (14,15) for moving said armature portion and attendantly said piston rod and piston;

a d.c. power source (409) for supplying a d.c. current;

a switching means (408) for switching said d.c. current to provide a pulsating current having a high level duration and a low level duration, said pulsating current being supplied to said electromagnet;

a current detection means (403) for detecting said pulsating current and outputting a current detection signal indicative of said pulsating current thus detected;

an integration means (404) for integrating said current detection signal and outputting an integration signal indicative of an integrated value of said current detection signal;

a comparison means (405) for comparing said integrated value with reference value and outputting a comparison signal indicative of a difference between said integrated value and said reference value; and a controlling means (405) responsive to said comparison signal for controlling said switching means to change said high level duration of said pulsating current, said controlling means controlling said switching means so that said integrated value coincides with said reference value.

15. A vacuum pump as defined in claim 14, further comprising a position detector means (407) for detecting a position of said armature portion and outputting a position signal indicative of the position thereof; a second comparison means for comparing said position signal with a second reference value and outputting a second comparison signal indicative of a difference between said position signal and said second reference value; and a second controlling means responsive to said second comparison signal for controlling said switching means to change said low level duration of said pulsating current, said second controlling means controlling said solenoid mechanism so as to be disposed in a predetermined position corresponding to said second reference value.

* * * * *